US006951251B2

(12) United States Patent
Penisson

(10) Patent No.: US 6,951,251 B2
(45) Date of Patent: Oct. 4, 2005

(54) JUNK BASKET AND METHOD

(75) Inventor: Dennis J Penisson, Raceland, LA (US)

(73) Assignee: Bilco Tools, Inc., Houma, LA (US)

( * ) Notice: Subject to any disclaimer, the term of this patent is extended or adjusted under 35 U.S.C. 154(b) by 0 days.

(21) Appl. No.: 10/959,291

(22) Filed: Oct. 6, 2004

(65) Prior Publication Data

US 2005/0072571 A1 Apr. 7, 2005

Related U.S. Application Data

(60) Provisional application No. 60/508,696, filed on Oct. 6, 2003.

(51) Int. Cl.[7] ..... E21B 37/00; E21B 31/08
(52) U.S. Cl. ..... 166/312; 166/99; 175/308
(58) Field of Search ..... 166/98, 99, 301, 166/312; 175/308

(56) References Cited

U.S. PATENT DOCUMENTS

| | | | | |
|---|---|---|---|---|
| 1,525,235 A | * | 2/1925 | Hansen | 175/308 |
| 1,753,339 A | * | 4/1930 | Hencken | 175/96 |
| 2,645,290 A | | 7/1953 | Fortenberry | |
| 2,660,250 A | | 11/1953 | Gage et al. | |
| 2,675,879 A | * | 4/1954 | Middleton et al. | 166/99 |
| 2,687,913 A | | 8/1954 | Baker | |
| 2,787,327 A | | 4/1957 | Pearson | |
| 2,797,755 A | * | 7/1957 | Bobo | 175/312 |
| 2,819,038 A | * | 1/1958 | Eckel | 175/99 |
| 2,834,300 A | | 5/1958 | Brock | |
| 2,894,725 A | * | 7/1959 | Baker | 175/312 |
| 2,912,227 A | * | 11/1959 | Baker | 175/312 |
| 3,118,510 A | * | 1/1964 | Woods et al. | 175/308 |
| 3,198,256 A | * | 8/1965 | Kirby, II | 166/99 |
| 3,814,180 A | | 6/1974 | Oliver | |
| 3,885,625 A | | 5/1975 | Ahlstone | |
| 4,059,155 A | | 11/1977 | Greer | |
| 4,111,262 A | * | 9/1978 | Duncan | 166/99 |
| 4,217,966 A | | 8/1980 | Garrett | |
| 4,276,931 A | | 7/1981 | Murray | |
| 4,390,064 A | | 6/1983 | Enen, Jr. et al. | |
| 4,828,026 A | | 5/1989 | Nelson | |
| 6,341,653 B1 | | 1/2002 | Firmaniuk et al. | |

OTHER PUBLICATIONS

Core Type Junk Basket from Gotco Internation-Junk-Catcher, Jul. 29, 2002.
Gotco International, Reverse Circulating Junk Basket, www.gotco-usa.com/junk-catchers/core_type_junk_basket.html.

* cited by examiner

*Primary Examiner*—Hoang Dang
(74) *Attorney, Agent, or Firm*—Browning Bushman P.C.

(57) ABSTRACT

Junk basket 10 is provided for collecting debris from a wellbore cleaning operation, and includes a central mandrel 14 having a throughbore 16 and an outer shell 24 defining a generally annular junk space 40. The outer shell 24 may be configured such that the annulus 27 includes a reduced portion 28. Flow holes 30 in the outer shell are preferably angled substantially upward, and are positioned to discharge fluid to the annulus 27. According to a method of the invention, fluid is passed from an upper tubing string, through the central mandrel, into the wellbore and upward through the annulus and past the flow holes, thereby reducing pressure of flow past the well holes to pass fluid from the junk space through the flow holes.

22 Claims, 2 Drawing Sheets

JUNK BASKET AND METHOD

RELATED CASE

The present application claims priority from U.S. Ser. No. 60/508,696 filed Oct. 6, 2003.

FIELD OF THE INVENTION

The present invention relates to an oilfield tool for positioning in a wellbore to collect debris during a wellbore cleaning operation. Oilfield tools of a type are commonly referred to as junk baskets. More particularly, the present invention relates to improved junk basket and method to collect debris from an oilfield wellbore.

BACKGROUND OF THE INVENTION

Various types of downhole tools, referred to as junk baskets, have been devised for collecting debris from a wellbore during a cleaning operation. The interior chamber within a junk basket may be open to the exterior of the junk basket by providing drain holes near the bottom of the junk basket receptacle. These drain holes may, however, become plugged so that fluid does not adequately drain from the junk basket. In other instances, the drain holes are sufficiently large that collected debris within the junk basket passes through the drain holes and back into the well.

Some junk baskets are complicated and are thus relatively expensive. Other junk baskets are not able to collect a substantial portion of the debris in the well, particularly when fluid circulates through the junk basket and upward through an annulus in the well as the basket is retrieved to the surface.

The disadvantages of the prior art are overcome by the present invention, and an improved junk basket and method are hereinafter provided for collecting debris from a wellbore.

SUMMARY OF THE INVENTION

In one embodiment, a junk basket for positioning in a wellbore to collect debris includes a central mandrel for connection at an upper end with an upper tubing string, and has a central throughbore for passing fluids downward from the upper tubing string, through the central mandrel, and through an exit port at the lower end of the central mandrel. An outer shell surrounds the central mandrel and defines a generally annular junk space between the central mandrel and the outer shell for collecting debris. The generally annular junk space is substantially closed at the lower end of the outer shell between the outer shell and the central mandrel, and is generally open to the wellbore at the top end of the outer shell. A plurality of flow holes are provided in the outer shell from the generally annular junk space into the annulus between the outer shell and the wellbore, such that fluid passing through the exit port in the central mandrel circulates upward through the annulus and past the holes. These flow holes may be angled within a range of from 5° and 60° relative to a plane perpendicular an axis of the central mandrel. The outer shell may include a radially outward portion below the flow holes having a reduced cross sectional annulus flow area for increasing fluid velocity in the annulus past the flow holes, and a radially inward portion below the radially outward portion and defining an enlarged cross sectional annulus flow area for reducing fluid velocity and thus fluid drag losses. The outer shell may also define an annular flow path above the flow holes which is greater than the annular flow path below the flow holes. According to the method, the junk basket may be moved vertically within the wellbore while passing fluid through the central mandrel, and the fluid circulation rate may be selectively controlled to control the flow rate from the generally annular junk space through the flow holes and into the annulus.

DETAILED DESCRIPTION OF PREFERRED EMBODIMENTS

Figure 1:
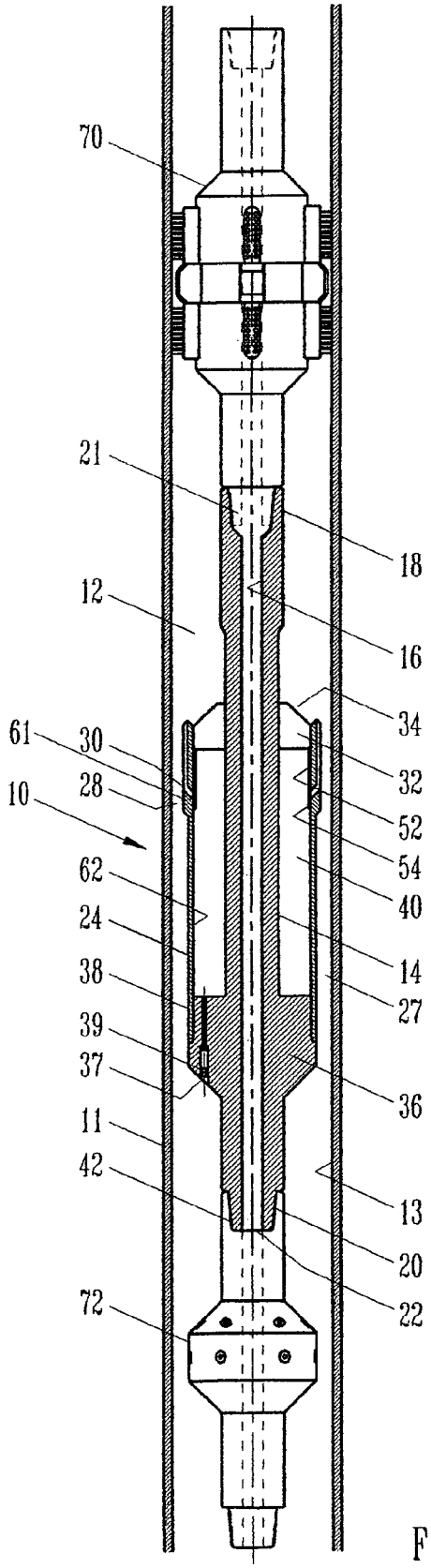
FIG. 1 is a cross sectional view of a suitable junk basket according to the present invention.

FIG. 1 illustrates a preferred embodiment of a junk basket 10 positioned in a wellbore 12, such as defined by the interior surface 13 of a casing string 11, to collect debris from a wellbore cleaning operation. The casing string 13 may be in fluid communication with a hydrocarbon formation. A central mandrel 14 has an upper end 18 for connection with an upper tubing string, a throughbore 16, and an exit port 22 at a lower end 42 for passing fluids from the upper tubing string, downward through the throughbore 16, and through the exit port 22. The upper end 18 of the central mandrel 14 may have a connector, such as a box type threaded connector 21, for connecting to the upper tubing string. Those skilled in the art recognize that fluid may continue downward past the port 22 through a lower tubing string before exiting and passing upward in the annulus between the casing string 17 and the tubing string.

An outer shell 24 surrounds the central mandrel 14 to form a generally annular junk space 40. The generally annular junk space 40 is generally open at a top end 34 of the outer shell 24, and an enlarged diameter lower end 36 of mandrel 14 is positioned for engaging the outer shell 24 and at least substantially closes the generally annular junk space 40 near a lower end 38 of the outer shell 24. The lower end 36 preferably includes one or more drain holes 37 for selectively draining fluid from the generally annular junk space 40. The drain holes 37 may be closed off, such as with plugs 39, to prevent drainage, and may be opened at the surface for fluid draining by removal of the plugs 39. One or more webs 32 may be provided between the central mandrel 14 and the outer shell 24 for radially spacing and supporting the outer shell 24 with respect to the central mandrel 14. Filter 52 covering the inside of the hole may be used in some applications, and may be eliminated in other applications. Filter 52 may rest on annular stop 54 secured to the outer shell 24.

An annulus 27 is defined within the wellbore 12 between the interior surface 13 of the casing string 11 and the outer shell 24 of the junk basket 10. The outer shell 24 is configured such that annulus 27 includes a reduced portion 28 having a reduced cross sectional flow area. The outer shell 24 includes a radially outward portion 65 (see FIG. 2) which is immediately below the holes or contains the flow holes, and defines the reduced cross-sectional annulus flow area for increasing fluid flow past the flow holes. The outer shell 24 as illustrated also includes a lower radially inward portion 63 defining a large cross-sectional annulus flow area for reducing fluid velocity and thus fluid drag losses. The radially outward portion 65 of the outer shell 24 thus preferably has a substantially cylindrical outer surface 61, which in a preferred embodiment is also the configuration for the radially inward surface 62 of the outer shell 24. A plurality of flow holes 30 in the outer shell 24 are preferably provided in the upper portion or upper half of the outer shell, and are preferably angled substantially upwards from the generally annular junk space 40 to the annulus 27, and preferably are positioned to discharge fluid to the reduced portion 28 of the annulus 27. The central axis of each flow hole 30 is thus preferably angled upward at from 5° to 60° relative to a plane perpendicular to the central axis of the tool.

The wellbore cleaning operation preferably entails additional cleaning tools for liberating debris within the wellbore 12 such as may be accumulated along the interior surface 13. For example, a brush or scraper type tool 70 may be positioned along the upper string, and/or a hydraulically powered jetting or circulating tool 72 positioned below the junk basket. Although tools may be positioned below the junk basket 10, the junk basket is typically at the lower end of the string. The lower end 42 of the central mandrel 14 may have a pin type threaded connector 20 for connecting with any tools below the junk basket 10.

During the wellbore cleaning operation, the cleaning tools may be used to liberate debris prior to and/or concurrently with passing fluid through the central mandrel 14 of the junk basket 40, then upward through the annulus past the junk basket. Fluid is thus passed from the upper tubing string, downward through the throughbore 16, and through the exit port 22 into the wellbore 12. Fluid passing into the wellbore 12 may gather and carry formation debris present within the wellbore 12. The fluid passes from the wellbore 12 upward through the annulus 28, possibly carrying with it debris from the wellbore 12 below the junk basket 40.

As the fluid passes through the upper portion 28 of the annulus 27 and past the flow holes 30, fluid pressure over the flow holes 30 is reduced relative to the pressure within the generally annular junk space 40. This "Venturi effect" results in fluid flow out of the generally annular junk space 40, through the flow holes 30, and into the upper portion 28 of the annulus 27. At a given volumetric flow rate, velocity increases with decreasing cross sectional area, such that fluid passing through the annulus 27 is accelerated as it passes into the reduced portion 28, increasing the Venturi effect and the resulting flow out through the flow holes 30.

To replace fluid flowing out of the generally annular junk space 40 through the flow holes 30, a substantially equivalent volumetric flow rate of fluid will flow from above into the generally annular junk space 40 through the top end 18 of the outer shell 24. This flow into the generally annular junk space 40 will help carry debris into the junk basket 10, while the upward flow through the annulus 27 will prevent debris from passing downward into the annulus. Thus, fluid and debris passing near and above the junk basket 10 will tend to collect in the generally annular junk space 40. Debris may enter the generally annular junk space 40 both from beneath the junk basket 10 after passing through the annulus 27, and from above the junk basket 10 after being liberated by the cleaning tools. While collecting debris in the generally annular junk space 40, the junk basket 10 may be moved vertically within the wellbore 12 during the wellbore cleaning operation. This vertical movement may increase the effectiveness of the wellbore cleaning operation by more thoroughly collecting debris along the wellbore 12.

The Venturi effect may occur even if the flow holes 30 are directed radially outward, i.e., at substantially 90 degrees to a central axis 44 of the wellbore 12. If, however, the flow holes 30 were angled downward, fluid would undesirably flow into the generally annular junk space 40, opposite the desired direction. Thus, the flow holes 30 are preferably angled upward to flow fluid into the annulus 28 from the junk space 40, preferably within a range of 5 to 60 degrees relative to a plane perpendicular to the central axis 44, to maximize the flow of fluid out of the generally annular junk space 40. The holes 30 in cross section may be round, although other hole configurations, such as elongated slots, oval holes, or square holes may be employed.

Particles smaller than the flow holes 30 may escape with liquids from the generally annular junk space 40 through the flow holes 30, so the diameter at the flow holes 30 may be reduced to trap more particles. Within a limited range, however, increasing a cross sectional flow area of the flow holes 30 may increase the Venturi effect, because the pressure reduction of the Venturi effect is a net force-per-unit-area directed out through the flow holes 30. Thus, to desirably increase the cross-sectional area of the flow holes 30 without excessively increasing hole diameter, the number of flow holes 30 may instead be increased.

In a preferred embodiment, the radially outer surface of at least a lower portion of the shell 24 for a medium or large diameter junk basket is recessed, thereby providing a relatively thin wall shell 63 below the holes 30. The wall thickness increases for the portion of the shell immediately below the holes 30, so that the enlarged diameter portion 65 of the shell as shown on FIG. 2 results in the substantially increased velocity of fluid as it passes the outward portion of the holes 30 compared to the velocity of fluid passing through the annulus 27 below the enlarged diameter portion 65. The radially outward portion of the shell adjacent and below the flow holes thus defines a reduced cross sectional annulus flow area for increasing fluid velocity in the annulus past the flow holes, thereby drawing fluid out of the annular junk space and into the annulus, while a radially inward portion 63 of the outer shell below the radially outward portion defines an enlarged cross sectional annulus flow area for reducing fluid velocity and thus fluid drag losses. The radially inward portion 63 may extend below the radially outward portion 65 to a lower end of the junk space 40.

Figure 2:
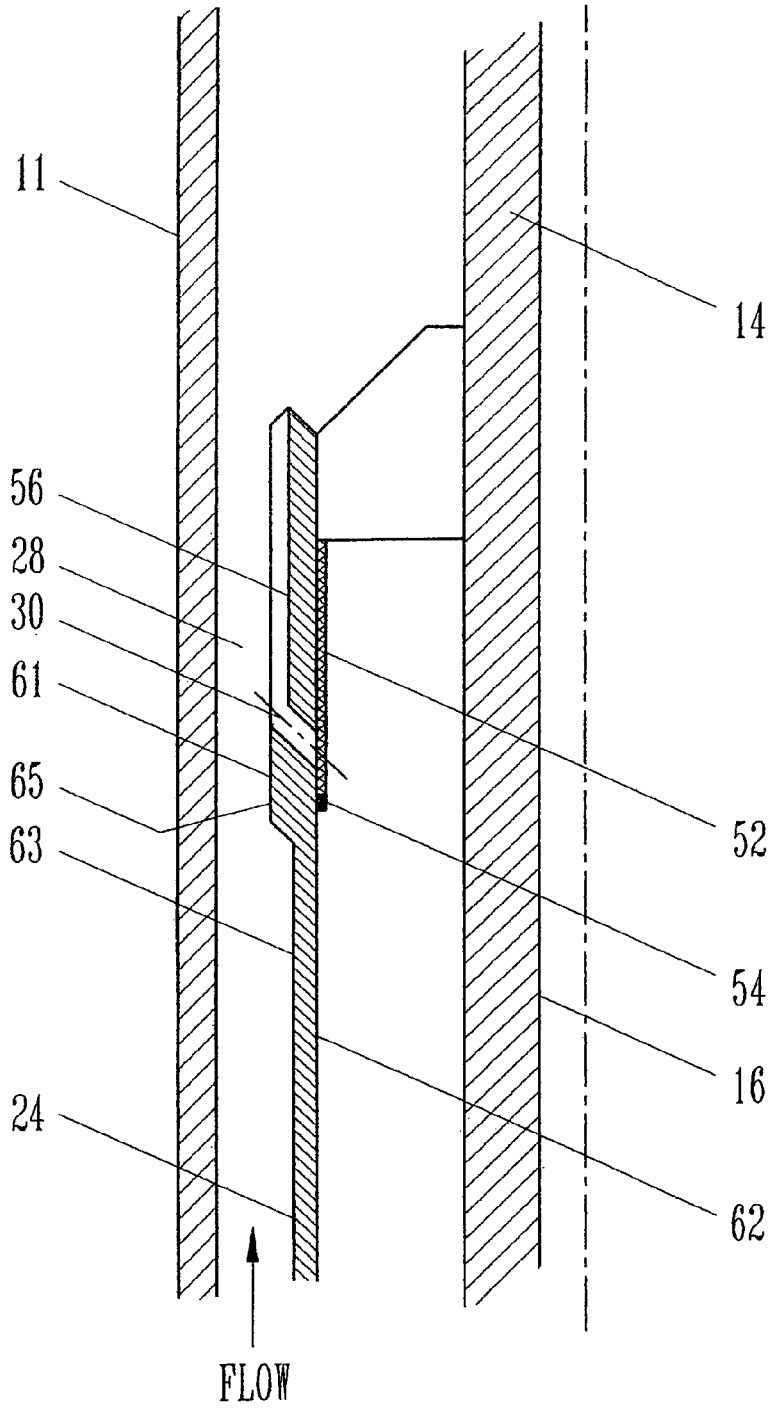
FIG. 2 illustrates in greater detail an alternative portion of the junk basket shown in FIG. 1.

A low hole angle or a hole with an axis substantially perpendicular to the central axis of the tool may also be satisfactory if the outer surface of shell 24 above the holes 30 includes a radially outward offset 56, as shown in FIG. 2, which has a reduced diameter, at least in part, compared to the diameter upstream of holes 30. The effect of the reduced diameter formed by the offset 52 as shown in FIG. 2 takes into consideration the fluid flow rate and depth of the offset. In a preferred embodiment, the hole angle and the offset work together to perform their desired functions. The desired amount of offset may be determined by design criteria, but the inclusion of an offset is a preferred feature of the invention. The diameter of shell 24 may be reduced downstream from (above) the flow holes so as to form a reduced wall thickness and a cylindrical outer surface similar to lower portion 63, or a slot may be provided downstream from (above) and in fluid communication with each flow hole. A preferred embodiment may use slots, such as slot 56 as shown in FIG. 2, for small diameter tools.

It should be understood that in an embodiment wherein jetting tools are provided above the junk basket, all the fluids pumped downhole will be used by the jetting tool to serve its desired purpose and no fluid will be passed on downstream to the junk basket. In other embodiments, however, a junk basket may receive, for example, 10% of the flow being pumped to the upstream jetting tool which leaves 90% of the flow to serve its desired purpose. The fluid circulation rate through the tool may be selectively controlled to obtain a desired flow rate from the junk space 40 through the holes 30.

Upon completion of the wellbore cleaning operation, the upper string may be moved upward to remove the junk basket 10 from the well. The plugs 39 may be removed from the drain holes 37 to drain fluid from the generally annulus junk space 40 after the basket is retrieved to the surface. The junk basket 10 may then be emptied into an appropriate waste receptacle and used again in a subsequent wellbore cleaning operation.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A junk basket for positioning in a wellbore to collect debris from a wellbore cleaning operation, the junk basket comprising:

a central mandrel for connection at an upper end with an upper tubular string, and having a throughbore for passing fluids downward from the upper tubular string, through the central mandrel, and through an exit port at a lower end of the central mandrel;

an outer shell surrounding the central mandrel and defining a generally annular junk space between the central mandrel and the outer shell for collecting debris, the generally annular junk space substantially closed at a lower end of the outer shell between the outer shell and the central mandrel, and generally open to the wellbore at an upper end of the outer shell;

a plurality of flow holes in the outer shell extending from the generally annular junk space into an annulus between the outer shell and the wellbore, such that fluid passing through the exit port of the central mandrel circulates upward through the annulus and past the holes;

a radially outward portion of the outer shell below the flow holes, the radially outward portion defining a reduced cross-sectional annulus flow area for increasing fluid velocity in the annulus past the flow holes; and a radially inward portion of the outer shell below the radially outward portion and defining an enlarged cross-sectional annulus flow area for reducing fluid velocity and thus fluid drag losses.

2. A junk basket as defined in claim 1, wherein the flow holes are upwardly angled at an angle within a range of between 5 and 60 degrees relative to a plane perpendicular to an axis of the central mandrel.

3. A junk basket as defined in claim 1, wherein the flow holes are positioned within an upper portion of the outer shell.

4. A junk basket as defined in claim 1, wherein the outer shell further comprises:

a plurality of vertically extending slots in the radially outer portion above the plurality of flow holes, each slot being in fluid communication with a respective flow hole.

5. A junk basket as defined in claim 1, wherein the outer shell further comprises:

an offset in the outer surface of the shell above the plurality of flow holes for decreasing fluid velocity in the annulus above the flow holes.

6. A junk basked as defined in claim 1, wherein the radially outward portion has a substantially cylindrical outer surface.

7. A junk basket as defined in claim 1, further comprising:

the radially inward portion extending below the radially outward portion to a lower end of the junk space.

8. A junk basked as defined in claim 1, further comprising:

one of a brush type tool, a scraper type tool, a hydraulic jetting tool, and a circulating tool positioned along the tubular string for liberating debris within the wellbore.

9. A junk basket as defined in claim 1, further comprising:

one or more webs between the central mandrel and the top end of the outer shell for radially spacing and supporting the outer shell with respect to the central mandrel.

10. A junk basket for positioning in a wellbore to collect debris from a wellbore cleaning operation, the junk basket comprising:

a central mandrel for connection at an upper end with an upper tubular string, and having a throughbore for passing fluids downward from the upper tubular string, through the central mandrel, and through an exit port at a lower end of the central mandrel;

an outer shell surrounding the central mandrel and defining a generally annular junk space between the central mandrel and the outer shell for collecting debris, the generally annular junk space substantially closed at a lower end of the outer shell between the outer shell and the central mandrel, and generally open to the wellbore at a top end of the outer shell; and a plurality of upwardly inclined flow holes in the outer shell angled substantially upward from the generally annular junk space into an annulus between the outer shell and the wellbore at an angle within a range of between 5 and 60 degrees relative to a plane perpendicular to an axis of the wellbore, such that fluid passing through the exit port of the central mandrel circulates upward through the annulus and past the flow holes, drawing fluid from the junk space into the annulus.

11. The junk basket as defined in claim 10, wherein the outer shell further comprises:

a radially outward portion below the flow holes, the radially outward portion defining a reduced cross-sectional area of the annulus for increasing fluid velocity in the annulus past the flow holes; and a radially inward portion below the radially outward portion and extending downward to a lower end of the junk space and defining an enlarged cross-sectional annulus flow area for reducing fluid velocity and thus fluid drag losses.

12. A junk basket as defined in claim 11, wherein the flow holes are positioned within an upper portion of the outer shell.

13. A junk basket as defined in claim 11, further comprising:

a plurality of vertically extending slots in the radially outer portion above the flow holes, each slot being in fluid communication with a respective flow hole.

14. A junk basket as defined in claim 10, further comprising:

an offset in the outer surface of the shell above the plurality of flow holes for decreasing fluid velocity in the annulus above the flow holes.

15. A method of collecting and containing debris within a wellbore using a junk basket positioned in the wellbore, the junk basket having a central mandrel and an outer shell, the central mandrel for connection at an upper end with an upper tubular string and having a throughbore in fluid communication with the upper tubular string, the outer shell surrounding the central mandrel and defining a generally annular junk space therebetween, the generally annular junk space substantially closed at a lower end and open at an upper end, the method comprising:

providing a plurality of flow holes in the outer shell extending from the generally annular junk space into an annulus between the outer shell and the wellbore;

providing the outer shell with a radially outwardly portion below the flow holes, the radially outward portion defining a reduced cross-sectional annulus flow area for increasing fluid velocity in the annulus past the flow holes, a radially inward portion below the radially outward portion and defining an enlarged cross-sectional annulus flow area for reducing fluid velocity and thus fluid drag losses; and passing fluid from the upper tubular string, through the central mandrel, through an exit port, into the wellbore upward through the annulus and past the flow holes, thereby drawing fluid from the generally annular junk space through the flow holes and to the annulus.

16. A method as defined in claim 15, further comprising:

moving the junk basket vertically within the wellbore while passing fluid through the central mandrel.

17. A method as defined in claim 15, further comprising:

selectively controlling fluid circulation rate through the exit port to control flow rate from the generally annular junk space through the flow holes.

18. A method as defined in claim 15, further comprising:

upwardly inclining each of the plurality of flow holes in the outer shell.

19. A method as defined in claim 15, further comprising:

forming a plurality of vertically extending slots in the radially outer portion above the flow holes, each slot being in fluid communication with a respective flow hole.

20. A method as defined in claim 15, further comprising:

forming an offset in the outer surface of the shell above the plurality of flow holes for decreasing fluid velocity in the annulus above the flow holes.

21. A method as defined in claim 15, wherein the flow holes are positioned within an upper end of the outer shell.

22. A method as defined in claim 15, further comprising:

the radially inward portion extending below the radially outward portion to a lower end of the junk space.

* * * * *